United States Patent [19]

Patillo

[11] Patent Number: 4,549,350

[45] Date of Patent: Oct. 29, 1985

[54] METHOD AND TOOL FOR REMOVING FLOOR COVERING

[76] Inventor: Glenn Patillo, 3765 Gondar Ave., Long Beach, Calif. 90808

[21] Appl. No.: 571,734

[22] Filed: Jan. 18, 1984

[51] Int. Cl.[4] ..... B26B 3/00

[52] U.S. Cl. ..... 30/170; 15/236 R

[58] Field of Search ..... 30/63, 79, 169–172, 30/136, 136.5, 335, 346; 15/236 R; 299/37; 173/24

[56] References Cited

U.S. PATENT DOCUMENTS

| | | | |
|---|---|---|---|
| 343,606 | 6/1886 | Pitney et al. | 30/171 X |
| 999,051 | 7/1911 | McCurdy | 30/170 |
| 1,241,577 | 10/1917 | Thompson | 30/170 |
| 2,279,454 | 4/1942 | Fischer | 30/170 X |
| 4,319,399 | 3/1982 | Ciaffone | 30/63 X |

*Primary Examiner*—Douglas D. Watts
*Attorney, Agent, or Firm*—Charles H. Thomas

[57] ABSTRACT

A tool is provided for removing floor covering bonded to a floor. The tool may be operated to simultaneously cut the floor covering into strips and peel the strips from the floor. The tool may be used with rotovinyl, asphalt, vinyl-asbestos and linoleum floor coverings. Removal of the floor covering is achieved using the tool while in a standing position. The tool includes a wedge shaped body, a channel shaped blade mounted in an inclined fashion at the nose of the body, a roller mounted behind the blade to roll upon the floor and hold the blade at a fixed angle relative to the floor, and an elongated handle rotatably connected to the body beneath the blade.

7 Claims, 6 Drawing Figures

METHOD AND TOOL FOR REMOVING FLOOR COVERING

BACKGROUND OF THE INVENTION

1. Field of the Invention

The present invention relates to methods and tools for removing floor covering bonded to a floor.

2. Description of the Prior Art

There are presently many types of floor coverings which are available and which are bonded throughout an expansive surface interface to a floor. Some of the commercially available floor coverings of this type include rotovinyls, asphalt tile, vinyl-asbestos tile and linoleum. In installing such floor coverings an adhesive is typically spread upon the floor and the floor covering is applied over the adhesive to secure the covering to the floor throughout its interface with the floor. Floor coverings of this type may be applied over different surfaces, such as wood, underlayment, concrete and other bare surfaces. Floor coverings of this type provide the floor with an attractive, decorative appearance, facilitate cleaning, and serve as a barrier to stains and other damage.

Ulitimately the surface of most floor coverings deteriorates with wear so that replacement eventually become necessary. Removal of such floor coverings, according to generally accepted techniques, is quite difficult and time consuming. According to accepted techniques of floor covering removal an old floor covering is cut into strips by a person working on his or her hands and knees. An edge of the strip is then manually pulled up by hand. However, the adhesive bond on the underside of the floor covering varies sufficiently throughout the surface of the floor so that parting of the floor covering from the underlying surface does not occur in a uniform plane. That is, patches of the floor covering are sometimes held quite fast to the floor although the surrounding floor covering is pulled up. Also, the strips of floor covering may carry with them patches of underlayment and hardened adhesive in significant thicknesses. With the conventional techniques of floor covering removal the surface remaining following removal of the floor covering is quite uneven. Patches of unremoved floor covering create bumps and elevations and cavities are created in areas where underlayment and adhesive have been removed with the floor covering.

According to conventional techniques, a floor covering is first manually cut into strips and the strips are removed from the floor. Then a workman must proceed to sand and patch the floor so as to even it out in preparation for a new floor covering to be placed thereatop. Patches and islands of the old floor covering which have theretofore resisted removal are subjected to a scraping action with a hand tool bearing a scoop-like blade. To remove the resisting patches of old floor covering it is frequently necessary to chop and hack at the sections of floor covering which remain following removal of the bulk of the floor covering. The necessary aggresive action to remove patches of old tile frequently subjects the surrounding floor area to considerable damage. Such damage is particularly extensive where the old floor covering has been laid upon a wooden floor. Wood floors are subjected to considerable gouging and scratching during tile removal using conventional tools and techniques.

Once the remaining patches of old floor covering have been removed, insofar as possible, it is necessary to fill in cavities which are left by adhesive and underlayment pulled from the surface of the floor, and by gouges and scratches resulting from the prior removal process. Cavities and gouges are filled in with a plaster-like substance. Once patching and filling have been completed, the filling compound must be allowed to dry. Thereafter, the entire floor surface must be sanded so as to provide a smooth, even, flat base for installation of a replacement floor covering. Sanding is typically performed with an electric sanding device.

Removal and replacement of a floor covering, according to conventional practice, involves hard, grueling manual labor which must be performed by a person on hands and knees. Furthermore, the removal process and the subsequent patching and filling is extremely time consuming and contributes very significantly to the cost of replacing a covering for a floor.

A further disadvantage with conventional techniques for floor covering removal arises from the fact that some floor coverings employ asbestos backings. It is now well known that sanding a surface covered with asbestos produces a significant health hazard to those performing the sanding operation, and to anyone else in the immediate vicinity. It is thought that individuals who breathe airborne asbestos fibers produced by sanding an asbestos covered surface may be exposed to an increased likelihood of contracting cancer.

SUMMARY OF THE INVENTION

In one broad aspect the present invention is a tool for removing a floor covering bonded to a floor. The tool is comprised of a body having a channel shaped blade mounted in an inclined fashion at a leading edge of the body. A roller is mounted at the rear end of the body to roll upon the floor and to hold the blade at a fixed, acute angle relative to the floor. An elongated handle is rotatably connected to the body. Use of the tool of the invention greatly alleviates the time and work involved in removing an old floor covering from a floor.

In another broad aspect, the invention may be considered to be a method of removing a floor covering bonded to a floor comprising cutting the floor covering into strips and simultaneously peeling the strips from the floor by pushing against an edge of the floor covering with the unique tool of the invention.

With the tool of the invention, cutting of an old floor covering into strips and peeling of those strips from the surface of the floor can be performed from a standing position. Moreover, use of the tool of the invention produces a separation of the old floor covering from the underlying surface along a much flatter plane of separation than has heretofore been possible. The angle of attack of the blade against the floor covering, and the bite or elevation of the blade above the surface upon which the roller travels are both maintained constant throughout the removal of any particular floor covering. As a consequence, strips of floor covering are removed in a uniform fashion so that the plane of separation of the floor covering from the floor is quite smooth, and requires only minimal scraping, patching and sanding.

The channel shaped blade of the tool of the invention has a base from which upright walls rise. The channel shaped blade thereby defines inner, concave surfaces and outer, convex surfaces. The inner surface of the exposed end of the base and the outer surfaces of the exposed end of the blade walls are sharpened to a knife edge and the channel shaped blade is inclined at an angle to the surface upon which the roller travels between about 12 degrees and about 18 degrees. When the tool handle is pressed against the tool body, the knife edge on one wall of the cutting end of the blade severs a strip from the mass of the floor covering to be removed while the base of the blade at the cutting end lifts the strip and peels it away from the remainder of the floor covering. Because the blade is rigidly secured to the body at a fixed angle of inclination, the tool peels away strip after strip of floor covering material without varying the plane of separation of the floor covering relative to the floor.

Although the bite or elevation of the exposed end of the blade base from the floor remains constant throughout separation of an expanse of floor covering, the tool of the invention is preferably provided with means for adjustably altering the bite or elevation so as to accomodate floor coverings having different thicknesses and means of attachment. Preferably, the body of the tool defines an inclined plane at the leading end and the underside of the blade resides in contact with the inclined plane. An opening may be defined within the blade base. A cam mechanism may be coupled to the body of the tool and is rotatable within the opening in the base to bear against the blade base at the edges of the opening. The cam mechanism may be rotated to selectively drive the blade up and down the inclined plane of the nose of the body so as to vary the bite or elevation of the exposed end of the blade base relative to the floor. With the leading end of the blade at the selected elevation, the cam mechanism and blade are retightened so that the bite will not vary during removal of any particular floor covering.

The tool of the invention is particularly useful in removing rotovinyl floor covering. Rotovinyl floor covering is formed as a laminar structure of foam having an asbestos backing on its underside and having an exposed vinyl surface with a photograph or other design produced by a rotogravure process. With the tool of the invention, the foam and vinyl layers of the rotovinyl can be removed while leaving the asbestos backing in place on the floor. The asbestos backing forms an excellent base for virtually any replacement floor covering. Since the cutting end of the blade is manipulated in swaths at an elevation from the floor equal to the thickness of the asbestos backing, there is little likelihood that the blade will catch on the supporting undersurface of wood or other material. The invention therefore minimizes gouging and virtually eliminates hand scraping, filling and sanding. A rotovinyl floor covering can be removed in about a third of the time that it takes with the prior conventional technique, hereinbefore described.

The tool of the invention will work over any underlayment and is operated by an individual from a standing position. The tool of the invention can be maneuvered to reach under toe kicks and to remove floor covering right up to the intersection of the floor with a wall.

The invention may be described with greater clarity and particularity by reference to the accompanying drawings.

DESCRIPTION OF THE EMBODIMENT AND METHOD OF THE INVENTION

Figure 1:
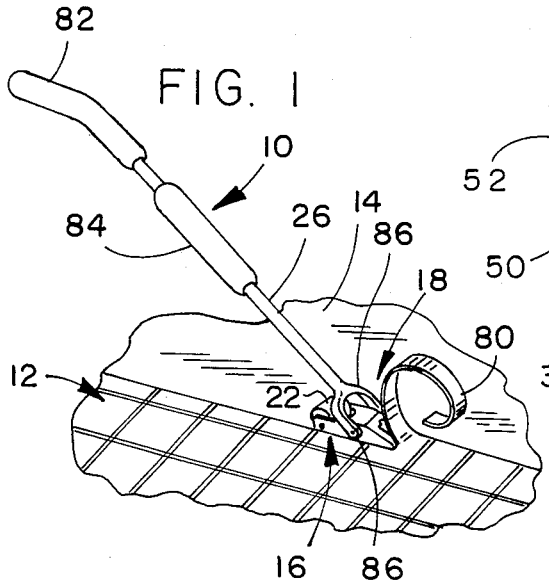
FIG. 1 is a perspective view illustrating use of the tool according to the method of the invention.

FIG. 1 illustrates a preferred embodiment of a tool 10 according to the invention. The tool 10 is designed to remove a floor covering 12 which is bonded to a floor 14. The tool 10 includes a body 16, a channel shaped blade 18, best depicted in FIGS. 2, 3, and 4. The blade 18 is mounted in an inclined fashion at a leading end 20 of the body 16. A roller 22 is mounted at the rear end 24 of the body 16. The roller 22 rolls upon the floor 14 and holds the blade 18 at a fixed, acute angle relative to the floor 14. The tool 10 also includes an elongated handle 26 which is rotatably connected to the body 16.

The body 16 is formed of a block of case hardened steel which is precision machined to define a wedge shaped nose at its leading end 20 and to define a pair of rearwardly extending arms 28 at its rear end 24. The body 16 is flat on its underside and defines an inclined, flat surface 30 on its wedge shaped nose.

The roller 22 is a molded polyurethane cylinder mounted upon an annular bearing 32 at its center. The roller 22 is embraced between the arms 28 and is mounted upon a transverse shaft formed by the shank of a bolt 34 that extends through coaxial, transverse apertures defined in the arms 28 near the rearward extremities thereof. A nut 36 on the shank of the bolt 34 secures the roller 22 between the arms 28. The roller 22 is freely rotatable upon the axle formed by the shank of the bolt 34.

The blade 18 is a channel shaped structure, preferably about four inches in length and about two inches in width. The blade 18 has a flat base 38 with an undersurface 46 which resides in contact with the inclined planar surface 30 of the body 16. A pair of longitudinal upright walls or rails 40 rise from the opposite, longitudinal edges of the base 38. The inner surface 42 of the base 38 and the inner surfaces 44 of the walls 40 define a concave channel shaped surface.

Figure 5:
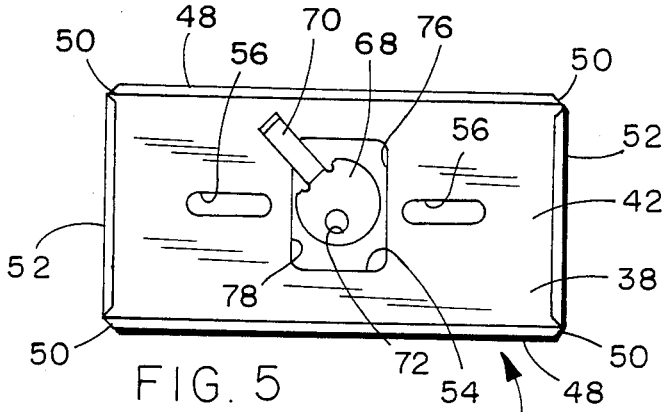
FIG. 5 is a plan detail of the blade and the height adjustment mechanism of the invention with the blade clamp removed.
Figure 2:
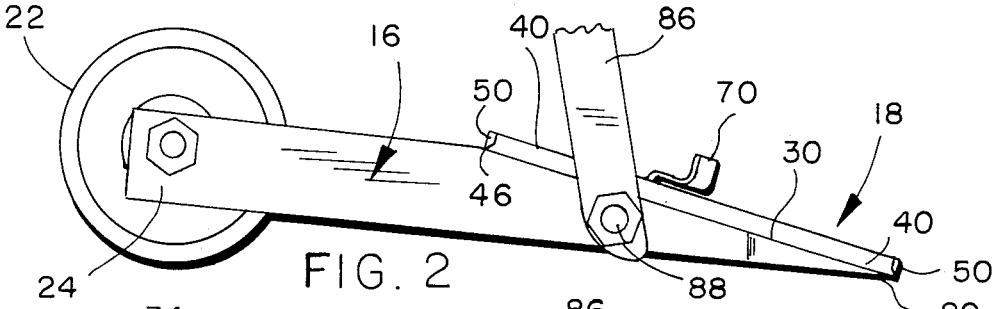
FIG. 2 is a side elevational view of a portion of the tool of the invention adjusted with a minimum bite.
Figure 3:
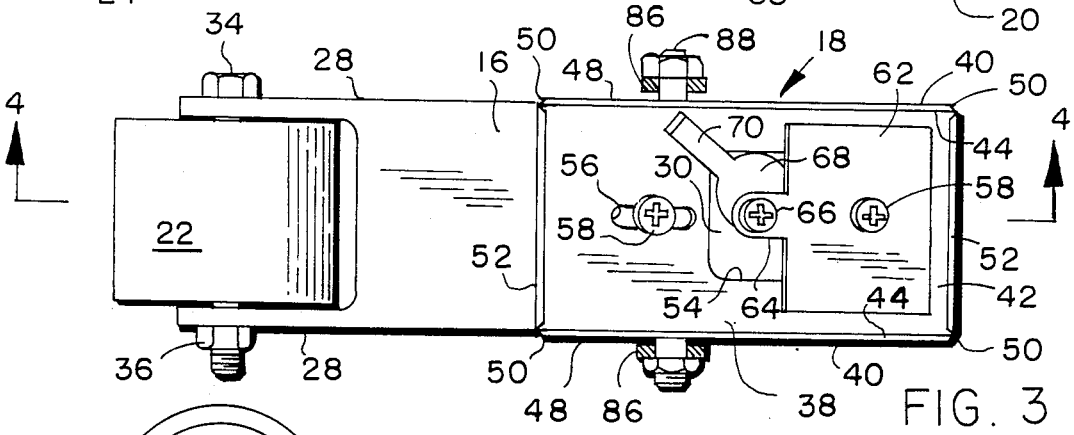
FIG. 3 is a top plan view of the portion of the tool of FIG. 2 adjusted so as to increase the bite of the blade.

As best illustrated in FIGS. 2, 3 and 5, the outer surfaces 48 of the blade walls 40 are sharpened to knife edges 50 at both ends of the blade 18. The inner surface 42 of the base 38 is likewise sharpened at both ends, and the knife edges are indicated at 52 thereon.

Since both ends of the blade 18 are honed to cutting edges, and since the blade 18 is removably mounted atop the body 16, as will hereinafter be described, the disposition of the blade 18 on the body 16 may be reversed. The reversible feature doubles the useful life of the blade 18. Preferably, the blade 18 is formed of annealed, double tempered spring steel. Such a construction provides the blade 18 with a long useful life. Moreover, the blade 18 will remain sharp through many uses, and can be resharpened many times with a stone or a professional grinder.

Figure 4:
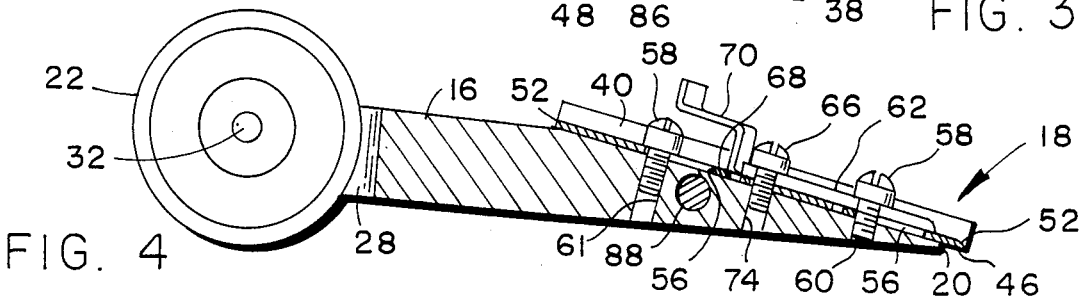
FIG. 4 is a sectional elevational view taken along the lines 4—4 of FIG. 3.

The blade 18 is illustrated in a top plan view in FIG. 5. At the center of the blade 18 a generally rectangular opening 54 is defined within the blade base 38. A pair of oblong slots 56 are also defined within the base 38 of the blade 18 equidistant from and on either side of the opening 54. The oblong slots 56 are defined to receive a pair of clamping screws 58 which extend through the slots 56 and into tapped bores 60 and 61 defined in the wedge shapened nose of the body 16, as illustrated in FIGS. 3 and 4. The shoulder of the head of the rearmost screw 58 bears directly against the inner surface 42 of the blade base 38 to tightly clamp the rearward end of the blade 18 to the body 16.

The forward screw 58 likewise serves to clamp the blade 18 in position atop the inclined plane 30, but acts through the center of a clamping plate 62, best illustrated in FIGS. 3 and 4. The clamping plate 62 is a generally rectangular steel plate having a rearwardly extending tab 64 with an aperture defined therein. The aperture 64 is adapted to receive another machine screw 66.

The machine screw 66 serves as an additional means for securing the clamping plate 62 to immobilize the blade 18 relative to the body 16. However, the machine screw 66 also serves another purpose. As illustrated in FIG. 5, a nearly circular cam plate 68 is located in contact with the inclined surface 30 of the nose of the body 16 within the confines of the opening 54 in the blade base 38. The cam plate 68 is of the same thickness as the blade base 38, and has an integrally formed actuating lever 70, defined in a dogleg shape as best illustrated in FIG. 4. As illustrated in FIG. 5, the cam plate 68 has an eccentric aperture 72 defined therein.

The forward machine screw 58 extends through an aperture in the clamping plate 62, through the forward slot 56 of the blade 18 and into the tapped aperture 60 in the nose of the body 16. The rearmost machine screw 58 extends through the base 38 of the blade 18 and into the tapped aperture 61 in the nose of the body 16. The machine screw 66 extends through the tab 64 of the clamping plate 62, through the cam plate 68, and into the tapped aperture 74 defined in the inclined surface 30 of the body 16 in longitudinal alignment with the apertures 60 and 61. When the machine screws 58 and 66 are loosened, the cam plate 68 can be rotated about the shank of the machine screw 66. Because the shank of the machine screw 66 passes through the eccentrically located opening 72 in the cam plate 66, manipulation of the lever 70 will cause the cam plate 68 to move in reciprocation to bear against the forward and rearward edges 76 and 78 of the generally rectangular opening 54 in the blade base 38.

With the machine screws 58 and 66 loosened, clockwise rotation of the lever 70 will cause the cam plate 68 to bear against the blade base 38 at the edge 76 to drive the blade 18 down the inclined surface 30 of the nose of the body 16. Conversely, counterclockwise rotation of the lever 70 will cause the cam plate 68 to bear against the edge 78 of the base 38 to drive the blade 18 up the inclined surface 30 of the nose of the body 16.

Manipulation of the lever 70 thereby provides a means for adjustably altering the elevation of the blade base 38 from the floor 14. When the lever 70 is rotated clockwise to bring the blade 18 forward, the leading end of the base 38 extends well forward of the end 20 of the body 16 and resides in contact, or near contact with the floor 14. When the lever 70 is rotated counterclockwise to the position of FIG. 2, the blade 18 is driven up the inclined surface 30 so that the leading end of the base 38 of the blade 18 is nearly longitudinally aligned with the end 20 of the body 16 at some distance above the floor 14. The interaction of the cam plate 68 with the opening 54 in the blade base 38 thereby provides a means for adjustably varying the bite of the cutting blade 18 relative to the floor covering 12. The bite can be increased so that the blade 18 will scrape very close to the floor 14. Alternatively, the bite can be reduced so as to leave a large portion of an adhesive or backing of the old floor covering 12, thereby minimizing possible damage to the floor 14.

When the cam plate 68 is rotated by means of the lever 70, the machine screws 58, acting within the slots 56, ensure that the blade 18 moves longitudinally relative to the body 16. When the bite of the blade 18 has been adjusted to the desired position, the machine screws 58 and 66 are tightened to securely clamp the blade 18 on the inclined surface 30 and prevent any further longitudinal movement of the blade 18 relative to the body 16 while the tool is in use.

As illustrated in FIGS. 2, 3, 4, and 6, the blade 18 is preferably aligned at an acute angle of between about 12 degrees and about 18 degrees relative to the floor 14, and preferably is aligned at an angle of about 15 degrees. With such an angle of blade alignment and with the bite of the blade adjusted appropriately for the floor covering 12 to be removed, the tool 10 can be pushed to rapidly cut strips 80 from the floor covering 12 and to peel those strips from the remaining floor covering as depicted in FIG. 1.

As illustrated in FIG. 1, the handle 26 is formed of aluminum tubing about $\frac{7}{8}$ of an inch in diameter and about 4 feet in length. The upper extremity of the handle 26 is bent in an obtuse angle to provide a comfortable hand grip. The upper extremity of the handle 26 is covered with a foam rubber grip 82 and another foam rubber grip 84 is separated from the grip 82 by about 3 inches. The grips 82 and 84 allow the user to maintain a secure hold on the tool 10, yet eliminate the need for gloves while still preventing the users hands from blistering.

The lower end of the handle 26 terminates in the yoke having yoke arms 86 which embrace the body 16 of the tool 10. The yoke is rotatably coupled relative to the body 16 by means of a transverse bolt forming an axle 88, visible in FIGS. 2, 3 and 4. The bolt 88 passes through a transverse bore in the nose of the body 16 beneath the inclined surface 30 and beneath the blade 18. The location of the connection of the yoke to the body 16 is quite important. If the bolt 88 is located too far to the rear the nose 20 of the body 16 will tend to rise. Conversely, if the bolt 88 is located too far forward, the roller 22 will tend to rise and the leading edge of the blade 18 will tend to dig into the floor 14.

For a body 16 about $6\frac{3}{4}$ inches in length the center of the bolt 88 should be between about $2\frac{1}{4}$ inches and $2\frac{3}{4}$ inches behind the nose 20 of the body 16. Preferably, the center of the bolt 88 is about $2\frac{1}{2}$ inches behind the nose 20.

In use the tool 10 is employed in the manner depicted in FIG. 1. If there is an accessible edge of the floor covering 12, the leading end of the blade 18 is merely positioned in abutment against the exposed edge of the floor covering and pushed forward by force applied on the handle 26. The roller 22 rolls upon the floor and propels the cutting blade 18 forward. The leading end of the cutting blade 18 cuts the floor covering 12 into strips 80 and simultaneously peels the strips 80 from the floor 14. The tool 10 is moved in swaths and can be used to rapidly cut and peel strips from the floor covering 12.

If there is no exposed edge at which to commence removal of the floor covering 12 with the tool 10, a small area of the floor covering 12 must first be scored with a knife and the circumscribed section can then be pulled up from the floor 14 at the scored edge to allow the roller 22 to contact the floor 14. Further removal of the floor covering 12 progresses in the manner previously described.

Figure 6:
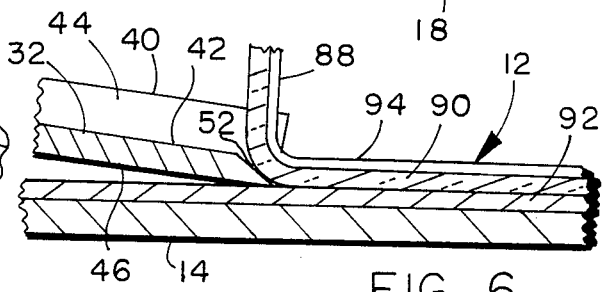
FIG. 6 is a sectional elevational detail illustrating the operation of the tool of FIG. 1.

As previously noted, the tool 10 has particular advantages when used to remove rotovinyl flooring. FIG. 6 illustrates a typical rotovinyl floor covering 12. The rotovinyl floor covering 12 is a laminar structure having an intermediate foam layer 90 and an underlying asbestos backing layer 92. The exposed layer 94 of the floor covering 12 is a vinyl layer having a pattern therein. The asbestos backing 92 is adhesively bonded to a floor 14, which may, for example, be a wooden floor.

For removal of rotovinyl floor covering 12, the machine screws 58 and 66 are loosened to allow the lever 70 to be rotated to adjust the bite of the blade 18 relative to the floor covering 12 to approximately the position indicated in FIG. 6. The bite of the blade 18 is adjusted so that the strips 80 of floor covering 12 are severed and lifted while leaving the asbestos backing 92. Removal of the floor covering 12 in this manner minimizes the risk of gouging to the floor 14 and causes each strip 80 to be removed along a uniform plane of separation parallel to the surface of the floor 14. Since the plane of separation is so smooth and uniform, it is unnecessary to sand the asbestos backing 92. This avoids the harmful effects of airborne asbestos fibers and dust which would otherwise be produced from sanding.

As the tool 10 is deployed in the manner depicted in FIG. 1, the knife edge 50 of the wall 40 of the blade 18 which contacts the floor covering 12 cuts a strip 80 from the floor covering 12. Simultaneously, the knife edge 52 of the base 38 of the blade 18 lifts and peels back the strip 80 from the remaining mass of the floor covering 12. Work progresses rapidly and the removal of the floor covering can be achieved from a standing position. The rotational, swivel connection provided between the handle 26 and the body 16 allows a user to cut the strips 80 in long swaths. The body 16 and blade 18 can be moved under toe kicks and right up to the surface of walls.

Undoubtedly, numerous variations and modifications of the tool of the invention and the manner of implementation of the method thereof will become readily apparent to those familiar with floor covering removal. Accordingly, the invention should not be construed as limited to the specific embodiment depicted nor to the manner of implementation of the method described. Rather, the invention is defined in the claims appended hereto.

I claim:

1. A tool for removing a floor covering bonded to a floor comprising a wedge-shaped body defining an inclined planar surface rising upwardly and rearwardly from a leading end of said body at an angle of between 12 degrees and about 18 degrees, a channel-shaped blade mounted in contact with said inclined planar surface at said leading end of said body and having a base from which upright walls rise, and the inner surface of at least one end of said base and the walls of said base at said same end are sharpened, a roller mounted at a rear end of said body remote from said leading end to roll upon said floor and to hold said blade at a fixed angle relative to said floor, an elongated handle rotatably connected to said body beneath said blade, and means for adjustably altering the elevation of said blade from said floor.

2. A tool according to claim 1 further characterized in that the inner surfaces of said base of said blade and the outer surfaces of said walls of said blade are sharpened at both ends, and said blade is reversibly mounted on said body.

3. A tool according to claim 1 further characterized in that said blade is inclined at an angle of about 15 degrees relative to said floor.

4. A tool according to claim 1 further characterized in that said handle terminates in a yoke which embraces said body and is rotatably coupled relative thereto.

5. A tool for removing floor covering bonded to a floor throughout a contact interface therebetween comprising: a body having a wedge-shaped nose with a channel-shaped cutting blade mounted thereatop at an angle of between about 12 degrees and about 18 degrees, whereby said cutting blade is formed with a base from which upright walls rise, and the inner surface of at least one end of said base and the walls of said base at said same end are sharpened, a roller rotatably mounted on said body behind said cutting blade to roll upon said floor and to hold said cutting blade at a fixed angle relative to said floor, an elongated handle rotatably coupled to said body beneath said blade and between said wedge-shaped nose and said roller, and means for adjustably varying the bite of said cutting blade relative to said floor covering.

6. A tool according to claim 5 further characterized in that both ends of said blade are honed to cutting edges and said blade is reversibly mounted atop said body.

7. A tool according to claim 6 further characterized in that an opening is defined within said blade base, and said means for altering blade elevation includes a cam mechanism coupled to said body and said cam mechanism is rotatable to bear against said blade base at the edges of said opening therein to selectively drive said blade up and down said inclined planar surface.

* * * * *